US008333279B2

(12) United States Patent
Veiseh

(10) Patent No.: US 8,333,279 B2
(45) Date of Patent: Dec. 18, 2012

(54) EXPANDABLE INSULATED PACKAGING

(75) Inventor: Charles Veiseh, Vernon, CA (US)

(73) Assignee: Simple Container Solutions, Inc., Vernon, CA (US)

( * ) Notice: Subject to any disclaimer, the term of this patent is extended or adjusted under 35 U.S.C. 154(b) by 390 days.

(21) Appl. No.: 12/283,395

(22) Filed: Sep. 11, 2008

(65) Prior Publication Data

US 2010/0062921 A1 Mar. 11, 2010

(51) Int. Cl.
*B65D 81/20* (2006.01)

(52) U.S. Cl. ..... 206/524.8; 206/594

(58) Field of Classification Search ..... 206/524.8, 206/499, 523, 594, 321
See application file for complete search history.

(56) References Cited

U.S. PATENT DOCUMENTS

| | | | | | |
|---|---|---|---|---|---|
| 2,194,451 | A | * | 3/1940 | Soubier | 206/526 |
| 3,302,815 | A | | 2/1967 | Morrison | |
| 3,458,966 | A | * | 8/1969 | Hullhorst et al. | 53/430 |
| 3,541,752 | A | * | 11/1970 | Ness | 53/436 |
| 4,025,974 | A | | 5/1977 | Lea | |
| 4,273,161 | A | | 6/1981 | McLaughlin | |
| 4,339,039 | A | | 7/1982 | Mykleby | |
| 4,555,017 | A | * | 11/1985 | Blackmore | 206/83.5 |
| 4,581,804 | A | | 4/1986 | McLaughlin | |
| 4,620,633 | A | | 11/1986 | Lookholder | |
| 4,636,416 | A | | 1/1987 | Kratel et al. | |
| 4,726,974 | A | * | 2/1988 | Nowobilski et al. | 428/69 |
| 4,793,490 | A | * | 12/1988 | Evert | 206/497 |
| 4,928,847 | A | | 5/1990 | Hollander et al. | |
| 4,985,106 | A | | 1/1991 | Nelson | |
| 5,100,016 | A | | 3/1992 | Wischusen, III | |
| 5,129,519 | A | | 7/1992 | David et al. | |
| 5,154,309 | A | | 10/1992 | Wischusen, III et al. | |
| 5,201,868 | A | | 4/1993 | Johnson | |
| 5,277,955 | A | * | 1/1994 | Schelhorn et al. | 428/74 |
| 5,316,149 | A | * | 5/1994 | Tate | 206/584 |
| 5,402,892 | A | | 4/1995 | Jaszai | |
| 5,402,906 | A | * | 4/1995 | Brown et al. | 426/106 |
| 5,515,975 | A | | 5/1996 | Jarvis | |
| 5,564,570 | A | | 10/1996 | Jaszai | |
| 5,626,814 | A | | 5/1997 | Vicino | |
| 5,706,969 | A | | 1/1998 | Yamada et al. | |
| 5,817,387 | A | | 10/1998 | Allwein et al. | |
| 5,826,404 | A | * | 10/1998 | Fuss et al. | 53/459 |
| 5,987,833 | A | | 11/1999 | Heffelfinger | |
| 6,220,473 | B1 | * | 4/2001 | Lehman et al. | 220/592.27 |
| 6,322,743 | B1 | * | 11/2001 | Stroobants | 264/321 |
| 6,464,229 | B1 | | 10/2002 | Kgler | |
| 6,513,974 | B2 | | 2/2003 | Malone | |
| 6,592,184 | B1 | | 7/2003 | Segal | |
| 6,651,277 | B1 | | 11/2003 | Marson | |

(Continued)

FOREIGN PATENT DOCUMENTS

| | | |
|---|---|---|
| EP | 0586232 | 3/1994 |
| EP | 0978455 | 2/2000 |
| EP | 1426305 | 6/2004 |
| WO | WO 98/59125 | 12/1998 |
| WO | WO 03/037145 | 5/2003 |
| WO | WO 2006/055452 | 5/2006 |

*Primary Examiner* — David Fidei
(74) *Attorney, Agent, or Firm* — Cislo & Thomas, LLP

(57) ABSTRACT

A packaging system comprising a panel and a storage device, wherein the panel comprises an insulator and a primary pouch enclosing the insulator. The primary pouch may have a ventilation hole. The storage device is configured to contain the panel in a compressed state. The storage device may be a secondary impermeable pouch, a set of rigid or semi-rigid platforms, or a set of restraint devices. The packaging system may be compressed using a press.

12 Claims, 6 Drawing Sheets

U.S. PATENT DOCUMENTS

| | | | | |
|---|---|---|---|---|
| 6,652,933 | B2 | 11/2003 | Hall | |
| 6,702,118 | B2 * | 3/2004 | O'Connor et al. | 206/494 |
| 6,776,747 | B2 | 8/2004 | Hall | |
| 7,231,751 | B2 | 6/2007 | Snell | |
| 7,600,635 | B2 * | 10/2009 | Kern | 206/83.5 |
| 2001/0036520 | A1 | 11/2001 | Hall | |
| 2002/0144482 | A1 * | 10/2002 | Henson et al. | 52/631 |
| 2004/0058792 | A1 | 3/2004 | Hall | |
| 2004/0180176 | A1 * | 9/2004 | Rusek, Jr. | 428/69 |
| 2006/0108370 | A1 | 5/2006 | Vasil' Yev et al. | |
| 2007/0051782 | A1 | 3/2007 | Lantz | |
| 2009/0313945 | A1 * | 12/2009 | Unruh et al. | 53/397 |

* cited by examiner

2/6

EXPANDABLE INSULATED PACKAGING

TECHNICAL FIELD

This invention relates to a packaging storage system and method for insulating and protecting goods during transport and storage.

BACKGROUND

A multitude of industries, worldwide, produce and transport goods that are heat and/or cold sensitive. Such industries include the fine food industry, confectioneries, meat and seafood, medical diagnostics, and industrial goods. Such goods are generally packaged at the plant where they are produced and prepared for shipping to customers or forwarded into a distribution channel.

Containers such as six-sided corrugated boxes are widely utilized for the packaging and transport of temperature sensitive goods. Corrugated containers offer excellent bulk storage characteristics as well as space-efficient collapsibility. Unfortunately, corrugated boxes do not exhibit significant insulation properties. In addition, corrugated board, although rigid and generally sturdy, does not greatly inhibit temperature transfer from the outside in or the reverse. Insulation materials are required for such a task.

Most insulation materials inhibit the transfer of heat by virtue of very common physical characteristics. Materials that are good insulators are generally high volume and low density materials. Unfortunately, high volume/low density materials such as fiberglass and Styrofoam obviously present storage inefficiencies.

A very effective and common product utilized to transfer temperature sensitive goods is a Styrofoam cooler. The rigid low density walls of such a product exhibit excellent insulation characteristics by slowing conductive heat transfer and providing adequate containment. Styrofoam containers are also quite rigid and are often utilized alone without a corrugated outside container. Unfortunately, Styrofoam containers typically do not collapse. The sheer bulk of such a product, especially in high quantities, produces significant inefficiencies, namely storage and transport.

Other types of insulation utilized are liners fitting the inside of corrugated containers. Such liners made of Styrofoam, ether/urethane cellular foams, or fibrous panels have proven to be very effective in producing an insulating effect inside corrugated containers. Such liners, however, also exhibit poor storage characteristics and are made of similar low density materials. It is important to note that such materials, generally presented in un-recycled form and first quality, are quite expensive. With ever increasing energy and raw materials prices, packaging options utilizing such materials, have experienced significant cost increases.

It is obvious that companies utilizing insulation materials generally need to assign a large amount of warehouse space for storage of such goods. Transportation (trucking) from the company providing the insulation to the company using it also becomes costly as volume is a strong factor in shipping cost. Consumption of fuel and space makes the transport and storage of bulky items, such as conventional insulation materials, increasingly expensive and prohibitive.

For the foregoing reasons there is a need for a cost-effective insulator and method of storing and efficiently transporting insulation materials utilized to package bulk amounts of temperature sensitive goods.

SUMMARY

The present invention relates to an efficient and cost-effective packaging and storage system and a method of using, storing and efficiently transporting such a packaging system.

The packaging system comprises a panel and a storage device. The panel typically comprises an insulator and a primary pouch enclosing the insulator, wherein the primary pouch has an opening through which the insulator is inserted and a ventilation hole through which air can pass. Prior to use, when the storage system is being stored or transported, the panels are maintained in a compressed state inside the storage device for efficient storage and transport.

DETAILED DESCRIPTION OF THE INVENTION

Figure 1A:
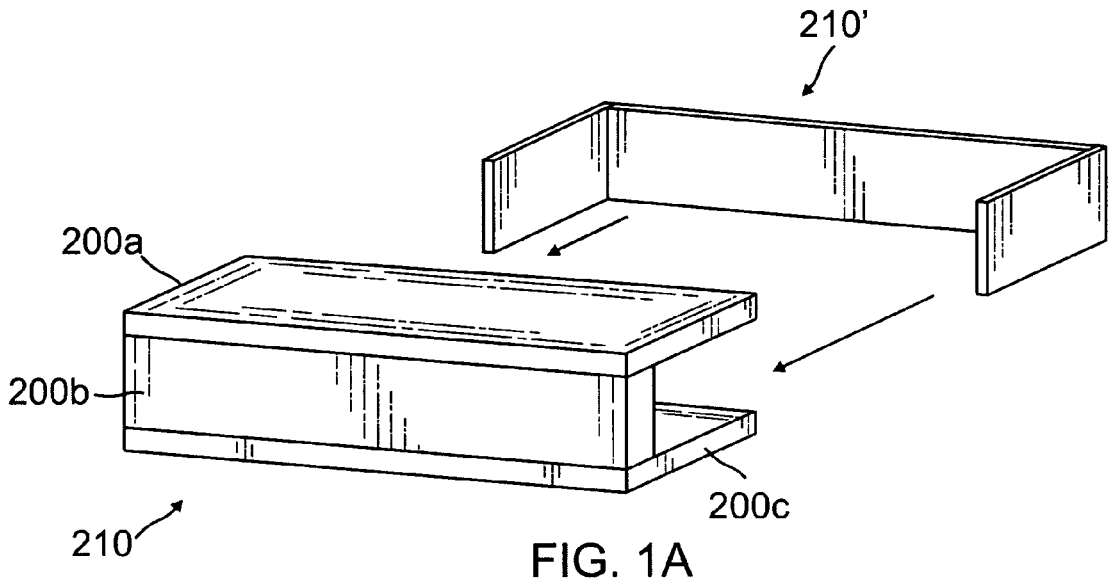
FIG. 1A shows an embodiment of present invention.

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

The packaging system 100 is an efficient and compact apparatus designed to protect and insulate goods from damage and undesired transfer of heat or cold. As shown in FIGS. 2A-2D, the packaging system 100 comprises a panel 200 to provide the protection and insulation and a storage device 202 configured to receive the panel 200 to efficiently store and transport the packaging system 100. The panel 200 is stored in a compressed state until the packaging system 100 is ready for use.

The panel 200 comprises an insulator 102 and a primary pouch 204 enclosing the insulator 102. The insulator 102 may be made from any material that provides cushioning and minimizes heat transfer, such as low density/high volume, elastic material. Elastic material is preferred due to its "memory" of its original shape after being altered. In other words, elastic materials tend to regain their original shape if they are deformed. Examples of such insulators are foam type insulators, such as urethane foam (polyether), recycled and bonded polyurethane foam ("rebond"), and the like. Recycled foam, while still performing as effectively as virgin materials, may be more cost-effective. Other low density/high volume insulators with elastic properties are fibers such as wool fibers, or synthetic polyester fibers. Preferably, the insulator 102 is made from polyurethane foam but other foams or materials may be used. The foam typically ranges from approximately 0.5 inch to approximately 1.5 inches thick, but can be varied to suit individual requirements. In some embodiments, the foam is approximately 1 inch thick. Polyether foams such as polyurethane foam, have excellent insulation characteristics as they present very high volume to weight ratios as well as generally excellent elasticity. Such materials also offer cellular segmentation characteristics. Such a material contains a plurality of segments or pockets within the body of a material. This slows the transfer of heat from one segment to another. It is important to note that such insulation inhibits the transfer of conductive heat, which is the heat that travels through solids. This segmentation augments the insulation capability of a material by minimizing the solids through which the heat can travel by creating buffer zones or air pockets through which heat is inefficiently transferred.

Furthermore, polyether foams can be easily compacted by purging any gases they hold via physical pressure or vacuuming. The materials' elasticity allows them to return to their original state after high-pressure compression. Several ether foams have low compression set ratings; specifically, the foams tend to return to a reasonably similar dimension after the compressive force that is applied to them is removed.

To protect and potentially increase the efficiency of the insulator 102, the insulator 102 may be placed inside a primary pouch 204. The primary pouch 204 may have an opening 206 through which the insulator 102 is inserted and a ventilation hole 208 to allow air to pass. In some embodiments, ventilation may occur through the opening 206. In a preferred embodiment the primary pouch 204 may be any type of container, envelope, enclosure, and the like, and made from any material that is substantially or completely gas and/or liquid impermeable. The primary pouch 204 may be constructed by any method to substantially enclose the insulator, such as insertion and sealing, wrapping, and the like, and may be constructed of one sheet or multiple sheets of material. Alternative embodiments may use a permeable primary pouch 204, depending on the nature of the goods to be shipped and the insulator 102 used. The primary pouch 204 may also be a coating around the insulator 102, the coating being plastic or other suitable material, applied to the insulator 102 by spraying, dipping, or other suitable means. Once the insulator 102 is placed inside the primary pouch 204, the primary pouch 204 may be sealed. For example, the primary pouch 204 may be heat sealed or sealed by radiofrequency, or with other suitable methods, such as adhesives, sealants, mechanical closure, vacuum valves, tape, or any combination thereof.

The primary pouch 204 may serve to generally configure the panels 200 together and can also serve to provide some separation between the insulator 102 and the products shipped, depending on the materials used. The venting of this primary pouch 204 has a negligible affect on the insulation characteristics of the insulator 102.

Certain insulation materials that may be used are essentially vapor impermeable—allowing only minute amounts of gases to pass through. Such insulators 102 need not be sealed in a gas or fluid impermeable material to remain effective. Therefore, in embodiments containing such insulators 102, the primary pouch 204 may not be required. Rather, individual insulators 102 may be connected using flexible "connectors", such as mesh, twine, straps, wires or other flexible material. The "connectors" may be imbedded within the insulator 102 wrapped or attached to the insulator 102 to interconnect two or more adjacent insulators.

A "connector" may also be made from the insulator material. An alternative to two or more insulators 102 interconnected by a primary pouch 204 is a single piece panel that is itself manipulated to behave like multiple adjacent panels. For example, a long piece of insulator may be crimped or formed where a bend would be located, such that it provides a bending point, which may also be a "connector." Optionally, such connected insulators 102 may be placed inside a similarly sized primary pouch 204.

Figure 2B:
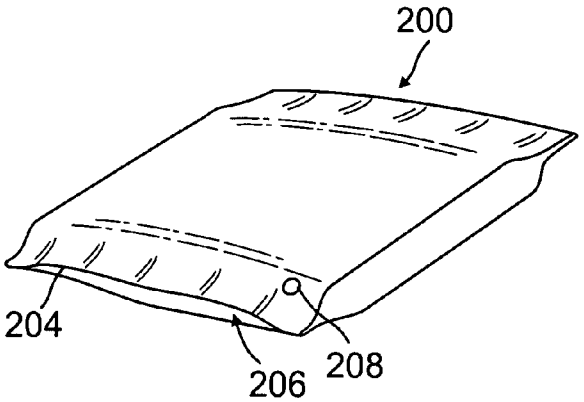
FIG. 2B shows a front perspective view of an embodiment of the panel.
Figure 2D:
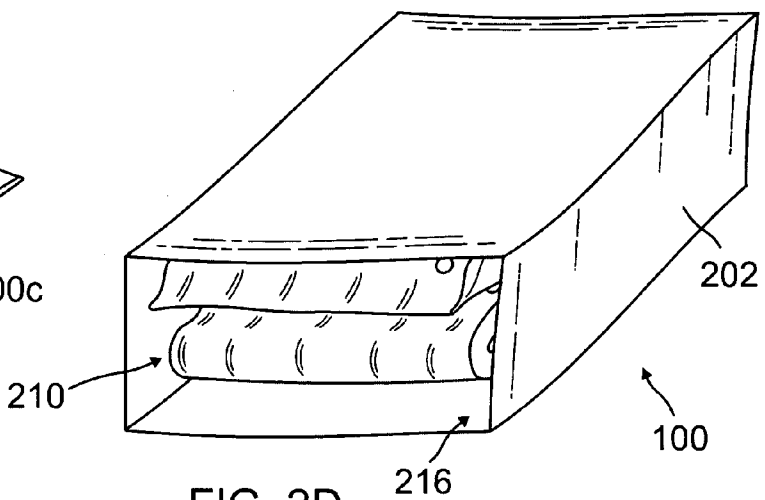
FIG. 2D shows a front perspective view of an embodiment of the packaging system.
Figure 2A:
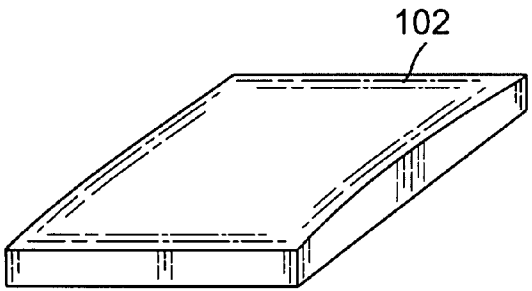
FIG. 2A shows an embodiment of the insulator.
Figure 2C:
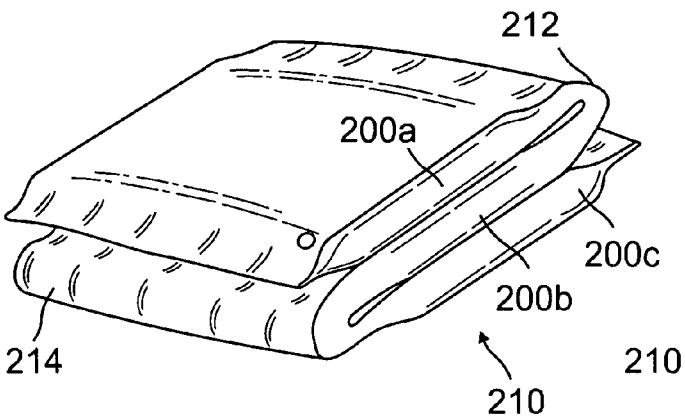
FIG. 2C shows a perspective view of an embodiment of a set of panels.
Figure 3A:
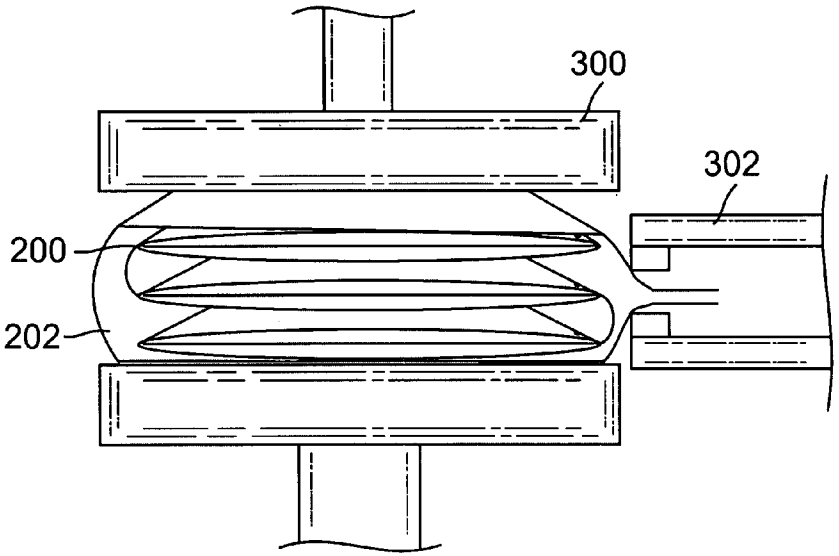
FIG. 3A shows a side view of the compression of an embodiment of the present invention with a portion of the secondary pouch removed for clarity.
Figure 3B:
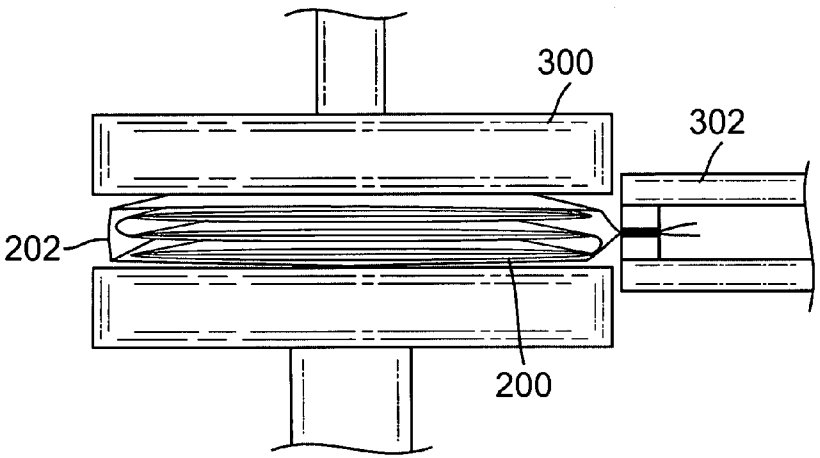
FIG. 3B shows the sealing of an embodiment of the present invention with a portion of the secondary pouch removed for clarity.

In some embodiments, the packaging system 100 is provided as a set of panels 210, wherein each panel 200*a*, 200*b*, 200*c* in the set of panels 210 comprises an insulator 102 enclosed inside a primary pouch 204. In some embodiments, each panel 200*a*, 200*b*, 200*c* in the set of panels 210 is connected to at least one other panel 200*a*, 200*b*, or 200*c* in the set of panels 210. Preferably, the set of panels 210 comprises three panels 200*a*, 200*b*, 200*c* interconnected in a linear fashion at two flexible connection sites 212, 214 to form two outer panels 200*a*, 200*c* and a middle panel 200*b*. In some embodiments, the set of panels 210 are interconnected simply by placing the insulators 102 spaced apart inside a single primary pouch 204. The spacing in between insulators 102 may be crimped closed to form the connection site 212, 214 to isolate the insulators 102 while forming connected panels 200*a*, 200*b*, 200*c* as shown in FIGS. 3A and 3B. In some embodiments, the spacing in between insulators 102 are not sealed so as to increase the adjustability of the insulators 102 inside the primary pouch 204. The spacings allow for flexibility of the panels 200*a*, 200*b*, 200*c* and serve as the connection sites 212, 214 for each insulator as shown in FIGS. 2C and 2D. These configurations provide for an easy and efficient manufacturing process since the panels 200*a*, 200*b*, 200*c* are arranged in a linear configuration, while still allowing the panels to be easily stacked on top of each other for efficient storage and transportation purposes. These panels can also be stacked in such a manner that unpacking the panels positions each panel in the proper orientation or configuration to line the box as discussed below.

Figure 1B:
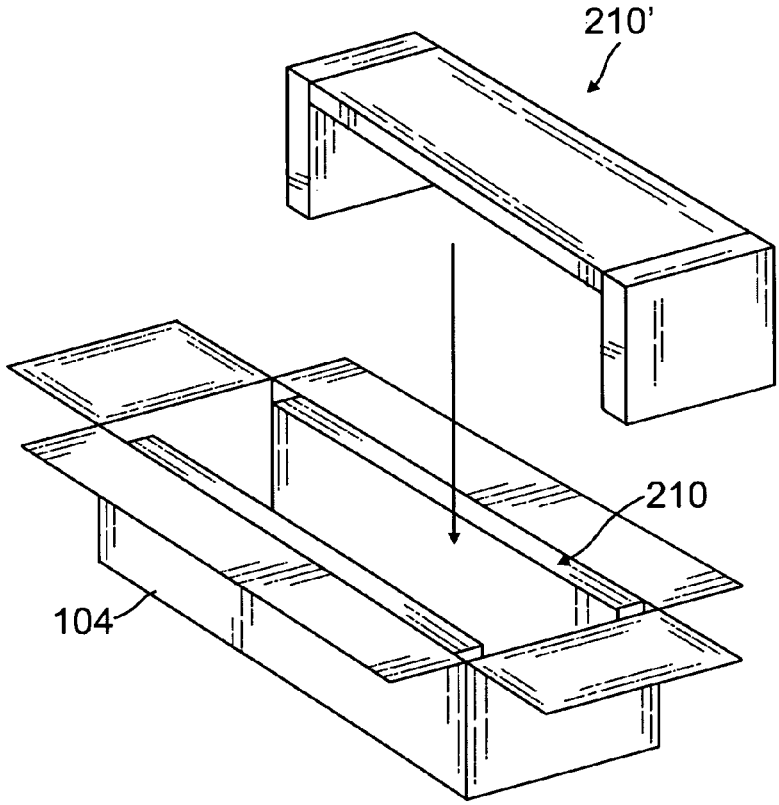
FIG. 1B shows the use of an embodiment of the present invention.

In use, a first set of panels 210 comprising three panels 200*a*, 200*b*, 200*c* can then be folded at the connection sites 212, 214 such that the two outer panels 200*a*, 200*c* are parallel to each other and perpendicular to the middle panel 200*b* to form a first partial box as shown in FIG. 1A. A second set of panels 210' comprising three panels interconnected in a linear fashion at two connections sites can be similarly folded at the connection sites to form a second partial box. The two partial boxes can be fitted together to form a complete box as shown in FIG. 1B. To this effect, the panels in the set of panels may be dimensioned to approximate the size of the wall of the box that the panel is intended to line. For example, if the box receiving the packaging system is cube shaped, then each of the panels would be of the same dimension, approximating the dimensions of the box. If the box receiving the packaging system is rectangular, then at least one panel will be of different dimensions than the other two panels, while the other two panels would be of identical dimension.

One method of assembly of the panels is illustrated whereby the first partial box may be placed inside of an actual box 104 to line three walls of the box, for example, the bottom and two opposite side walls as shown in FIG. 1B. The goods to be shipped may then be placed inside the box on top of the first set of panels 210. The second set of panels 210' may then be fitted into the box 104 to line the remaining opposite side walls and cover the top, thereby completely enclosing the goods inside the two sets of panels 210, 210' inside the box 104. As another example, the first partial box may line the bottom, one side wall and the top. The top may be lifted up so that the second partial box can be inserted so as to cover the remaining three side walls. The top may then be closed. The box 104 may then be sealed and ready for transport or storage. Due to the lining of the box 104 by the packaging system 100, the goods inside are insulated from heat transfer and protected from physical damage. Therefore, hot or cold items packaged using such an insulation method will retain their respective temperatures for longer periods of time when the package is in an environment that is at a different temperature.

Two-panel sets may also be used. In such situations, the two set panels make up two of the walls of a six sided box. Three two-panel sets would be required to complete the lining of the box.

In some embodiments, the set of panels 210 may comprise five or six panels capable of forming a complete or near complete box. For example, four panels may be interconnected in a linear fashion with two outer panels and two inner panels. Two additional side panels may be attached to the same outer panel, different outer panels, the same inner panel, or different inner panels. In a preferred embodiment, the additional side panels are attached to different outer panels on opposite sides forming a "Z" configuration to facilitate the stacking process. For storage, each panel can be bent at 180 degree or −180 degree angles at the connection site relative to an adjacent panel to stack the panels on top of each other like a "column" ready for compression. In use, each of the panels can be "opened" or unfolded from its stacked configuration so that the panels 200*a*, 200*b*, 200*c* form right angles at the connection site relative to each adjacent panel to form a complete box configuration. This box configuration can then be placed inside an actual packing or storing box.

Although a six-sided cuboid (hexahedron) is the most common shape for a shipping box, many other configurations may be necessary or desired depending on the shape of the goods to be shipped. The set of panels 210 and/or insulators 102 of the present invention may be adapted to fit such "boxes," whether they are comprised of flat-paneled, curved, cylindrical, or other three-dimensional shapes in various combinations. Adapting the present invention to fit such shapes and still be adapted for compression and re-assembly should be well within the ordinary skill in the art.

To improve the efficiency of storing and transporting the packaging system 100, the packaging system 100 may further comprise a storage device 202 or 500. The storage device 202 or 500 may be a secondary pouch 202 to enclose and contain at least one panel 200 or at least one set of panels 210. The secondary pouch 202 may be made from any pliable, impermeable or near-impermeable membrane. In one embodiment, the membrane is closed at three edges or sides and open at a fourth side 216. Preferably, the membrane is impermeable to fluids, gases, and vapors. For example, the membrane may be made of a plastic material. A preferred material is thermoplastic film, as it is readily heat sealable. In some embodiments, the thermoplastic film comprises a vapor barrier material such as metalized film, a metal film, nylon containing film, metalized polyester bonded to a thermoplastic, such as polyethylene, or vacuum seal material. Vacuum seal materials may also be made of nylon blends that are nearly gas impermeable.

To improve the efficiency of storage and manufacture of the packaging system 100, the panels 200 or set of panels 210 may be folded over so that the individual panels are stacked in a column-like cushion as shown in FIG. 2C. The stacked set of panels 210 can then be placed inside the secondary pouch 202 through the open side 216 (referred to as the front for ease of reference only) as shown in FIG. 2D. The set of panels 210 can also be inserted into pouch 202 one at a time. The secondary pouch 202 containing the set of panels 210 can then be placed under a compressor 300 that can compress the set of panels to a much thinner state as shown in FIGS. 3A and 3B.

This multi-panel compression technique has advantages over methods that require individual panels 200 to be individually sealed and inflated. It also avoids a tedious method of manufacture as well as labor intensive usage characteristics. In addition, as the requirement for maintaining a compressed state is that the film utilized for such a task remains fluid impermeable, the risk of flawed film is greater when utilizing traditional methods. Furthermore, a greater net square footage of fluid impermeable film would be involved in seamlessly packaging individual panels as opposed to that required to compress and package all such panels in bulk.

The present invention minimizes the "square footage" of fluid impermeable material required and thus increases the likelihood of a successful "air-tight" seal by minimizing the risk of inherent material flaws. Furthermore, the burden of creating individual air-tight seals and producing multiple amounts of perfect or near perfect seals while under pressure in order to maintain a compressed state, is reduced. Furthermore, the time and labor required to release the multiple air-tight seals upon use is reduced as well. An embodiment of the present invention reduces the net amount of seals required by virtue of packaging multiple numbers of panels 200 into an outer fluid-impervious container 202 that is itself sealed thereafter. The risk and labor required to maintain the temporary compact state is thus reduced. As stated earlier, the net amounts of compressive action to reduce the size of the panels 200 is reduced by compressing groups of panels simultaneously. This obviously reduces labor, energy and preparation requirements.

Once compressed, the open side 216 of the secondary pouch 202 may be sealed with a sealer 302 in a fastening step, for example, using a heat sealer, radiofrequency welder, tape or other types of adhesives, a zipper storage bag such as those sold under the trademark ZIPLOC®, vacuum valve, mechanical closure, sealants and the like or any combination. Since the impermeable secondary pouch 202 is sealed, air cannot re-enter the secondary pouch 202 and the set of panels 210 remain in a compressed state, thereby, allowing more panels 200 to be stored or transported in any given space than if such panels were in a fully expanded state.

Although a preferred embodiment of the secondary pouch 202 is sealed on three sides, other embodiments may be constructed from separate sheets of membrane, sealed together on all sides after compression. In such an embodiment, a pair of pre-cut sheets of membrane may be utilized on top and below the panels 200. The panels may then be compressed and all four sides sealed. Any excess material can be cut before or after the sealing process. To automate the system, the membrane, which may be perforated, scored, or pre-cut for easy tearing, may be fed from rolls from above and below the panels as the panels pass through on a conveyor belt to envelop the panels 200 via "sandwiching." The sandwiched panels 200 can then be passed through a compressor, which may be equipped with the sealer 302 and a cutter to compress the panels 200. The same effect is achieved by utilizing a vacuum device in place of the compressor. The panels 200 can be compressed, sealed in a secondary pouch 202, and the excess material, if any, cut before, during or after sealing at a single station to package the panels 200 in an outer pouch 202. In some embodiments, the sealer 302 and the cutter may be the same device. In other words, the sealer 302 may also be utilized to cut the material.

The ventilation hole 208 of the primary pouch 204, can be utilized for purging any air or gas trapped inside the pores, pockets, or segments of the insulator 102 contained inside the primary pouch 204 during the compression stage. At least one surface of the primary pouch 204 may define a ventilation hole. Although the ventilation hole 208 may be positioned anywhere on the primary pouch 204, to avoid obstructing the ventilation hole 208 during compression, the ventilation hole 208 is preferably placed along the edges of the primary pouch 204. In some embodiments, the ventilation hole 208 may be a slit along one of the edges of the primary pouch 204. In other embodiments, the ventilation hole 208 may be a product of an incomplete seal of the opening 206 of the primary pouch 204. It may be advantageous to place several if not many ventilation holes on the primary pouch 204 whereby during compression, gases to be purged can more easily escape and are not "trapped" in pockets between the insulator wall and primary pouch 204. The same is true for the decompression process. Furthermore, when multi-panel configurations such as three-panel systems are utilized, panels can be bent and manipulated much more freely whereby air pockets formed by movement of the panels do not impede their movement. It is not uncommon to observe a vacuum effect when two adjacent panels sealed in the same envelope are manipulated or moved. The movement seems to create a fluctuation in the volume inside pouch which produces a movement restricting vacuum effect as the primary pouch 204 clings to the panel inside.

In some embodiments, the ventilation hole 208 may be in the form of "perforations" in the primary pouch 204, comprising a multitude of small openings that allow both easy compression and decompression as well as less restricted movement during assembly.

Figure 4A:
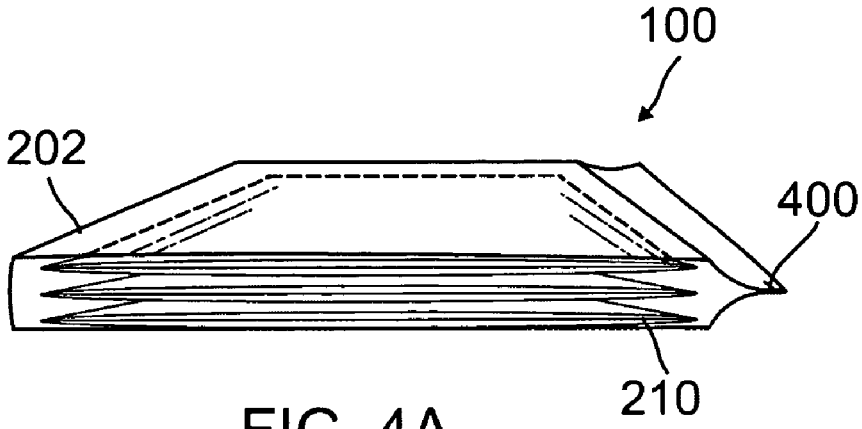
FIG. 4A shows a side view of an embodiment of the present invention in a compressed state with a portion of a side of the secondary pouch removed for clarity.
Figure 4B:
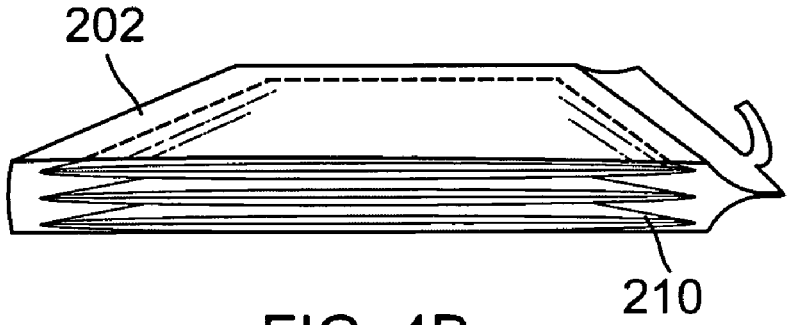
FIG. 4B shows the embodiment shown in FIG. 4A being opened.
Figure 4C:
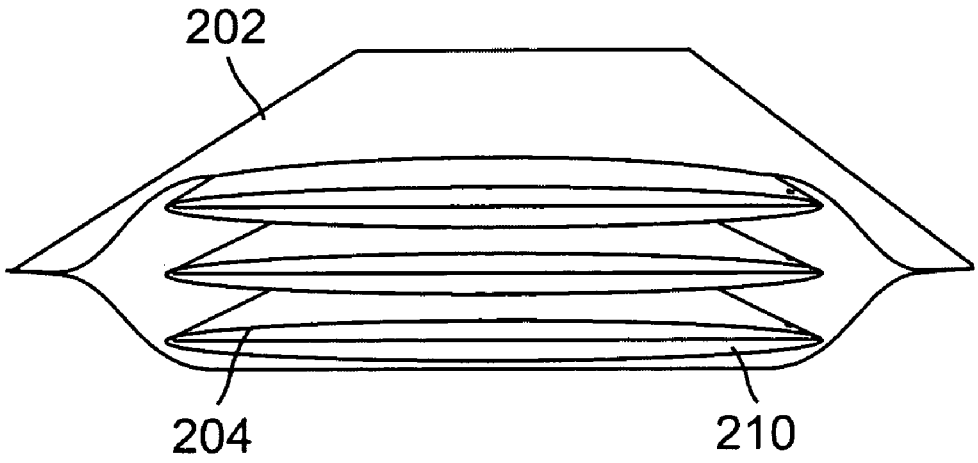
FIG. 4C shows a front view of the embodiment of FIGS. 4A and 4B in a non-compressed state.

During the decompression stage, as shown in FIGS. 4A-4C, when the secondary pouch 202 is unsealed, air or gas can re-enter into the primary pouch 204 through the ventilation hole 208 and into the pores, pockets, and segments of the insulator 102 as the insulator 102 expands back into its natural form. The panels 200 can be removed and used for their intended function. A user simply opens the storage device 202 or 500 introducing air into the primary vented pouches 204 containing the insulator 102. The elastic nature of the multiple panels of polyethers and other elastic insulation materials, facilitates their return to their expanded, better insulating state. In embodiments utilizing a secondary pouch 202 as the storage device, a convenient method of unsealing such a secondary pouch is to provide a pre-cut slit 400 near top edge of secondary pouch, thus eliminating the need for cutting instruments such as scissors.

Although the ventilation hole 208 may be left open after the storage device 202 or 500 is opened, the ventilation hole 208 may be sealed after the insulators 102 have expanded. Such sealing may increase the insulating and cushioning properties of the panels 200 by eliminating all air exchange through the ventilation hole 208. Such sealing may be accomplished by covering the ventilation hole 208 with tape, using adhesive to seal any overlapping material that may form the ventilation hole 208, utilizing a valve, or other suitable methods of sealing.

In some embodiments, multiple sets of panels 210, 210' may be placed inside the secondary pouch 202. In addition, a plurality of secondary pouches 202, 202' each containing at least one set of panels 210 can be stacked on top of each other and placed in the compressor 300 for bulk compression. The sets can also be compressed by vacuum. The plurality of secondary pouches 202, 202' may be sealed together or individually.

Figure 5A:
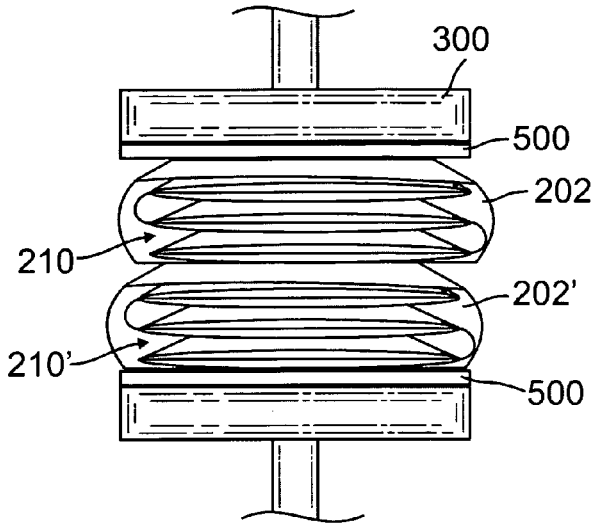
FIG. 5A shows an embodiment of the present invention shown with a compressor.
Figure 5B:
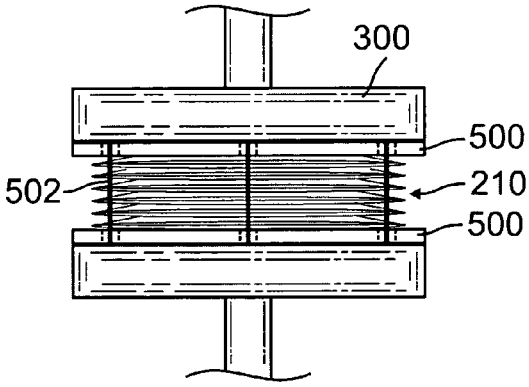
FIG. 5B shows an embodiment of the present invention being compressed.
Figure 5C:
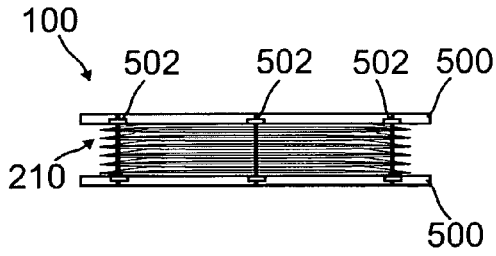
FIG. 5C shows an embodiment of the present invention in a compressed state.
Figure 6:
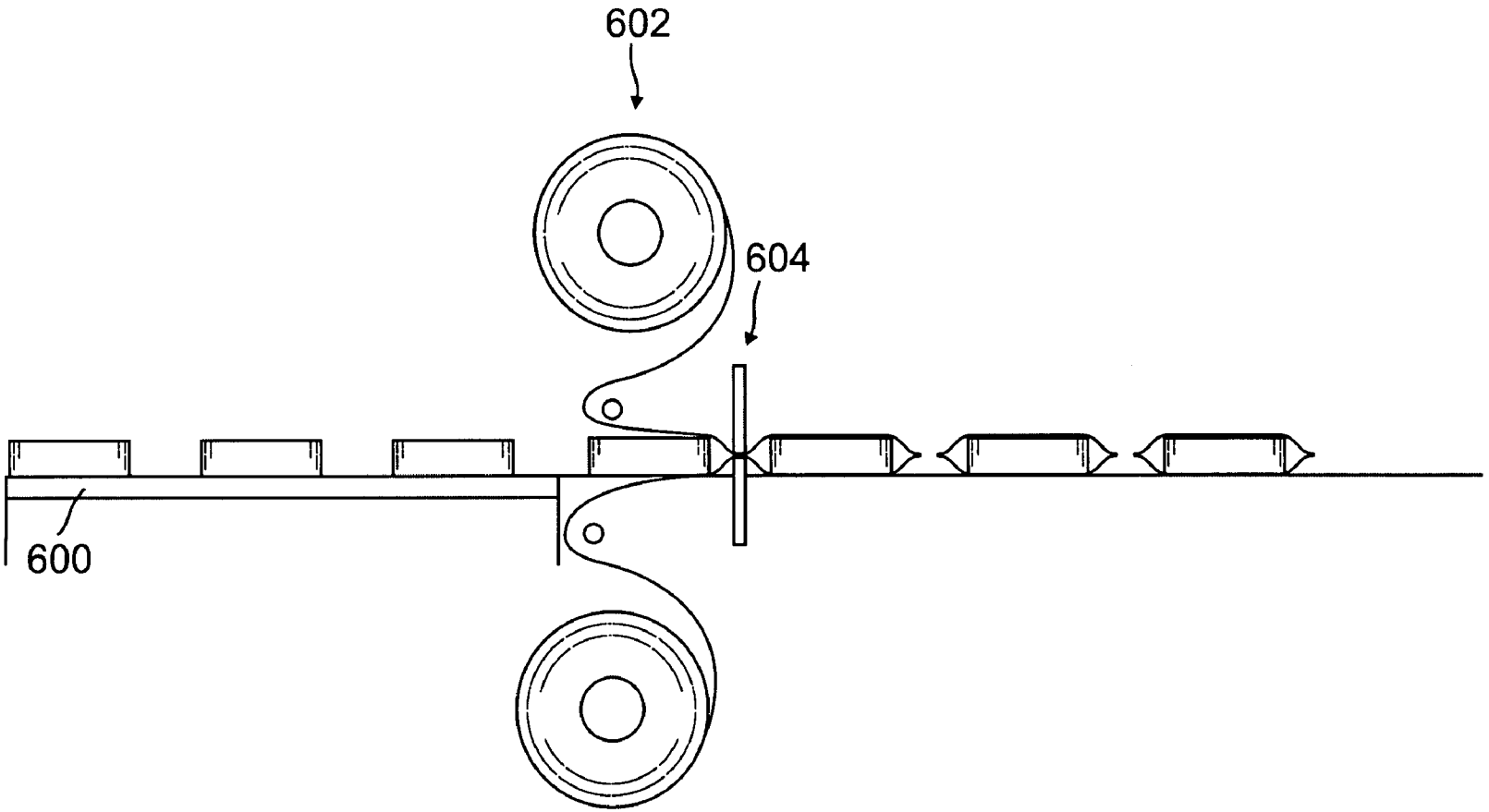
FIG. 6 shows an automated method of manufacturing an embodiment of the present invention.

In some embodiments, the storage device may be a pair of rigid or semi-rigid platforms 500. The set of panels 210 may be folded over on to each other so as to be stacked as shown in FIGS. 5A-5C. At least one stacked set of panels 210 may then be placed or "sandwiched" in between the pair of rigid or semi-rigid platforms 500. The set of panels 210 may then be compressed in between the platforms 500, thereby drawing the pair of platforms 500 together. Once the compression is complete, the platforms 500 may be fastened or bailed together with a fastener 502 in a fastening step so that the compressed set of panels 210 maintains a compressed state. When the set of panels 210 are ready for use, the fasteners 502 can be released to allow the set of panels to decompress or expand. Due to the high decompression force, several fasteners may be utilized.

To reduce the hazard of rapid and violent decompression, the number of compressed panels should be limited as the amount of expansion force produced is proportional to the number of panels compressed. To further accomplish safely controlled expansion, the insulators 102 could be made of material that expands at a controlled rate, the ventilation hole 208 could be sized or valved so that the expansion is controlled to a suitable rate, or any combination of the above.

The fasteners 502 can be any type of fastening device such as straps, bands, ropes, wires, and fastening hardware such as nuts and bolts, screws, buckles, seals, and the like, or non-hardware heat seals, friction welds, and the like, or any combination thereof. The fasteners 502 must be strong enough to maintain the panels 200 in a compressed state.

The platform 500 can also be made out of any rigid or semi-rigid, sturdy material such as plastic, metal, multi-layer paperboard, wood, fiberglass, carbon-fiber, and the like. Preferably, the platform 500 is lightweight and strong so as to facilitate the storage and transportation process, yet withstand the forces applied by the compressor 300.

In some embodiments, the secondary pouch 202 and the platforms 500 may be combined. To facilitate the ease of distribution a set of panels 210 or multiple sets of panels 210 may be stacked and placed inside the secondary pouch 202. At least one secondary pouch 202 containing at least one stacked set of panels 210 can be placed in between a pair of platforms 500. Once compressed, the secondary pouch 202 can be sealed and the platforms 500 may be fastened together. Furthermore, multiple pairs of platforms 500 may also be stacked on top of each other with each pair of platforms sandwiching at least one set of panels 210 or at least one secondary pouch 202 containing at least one set of panels 210.

In some embodiments, the storage device may be a plurality of restraint devices, such as bands, straps, belts, and the like. A set of panels 210 may be stacked and fastened or bound together with the restraint device. In some embodiments, the restraint device may be a type of fastener 502 used in the platform embodiment, but without the platforms. Therefore, the restraint device or the fastener 502 binds or fastens the set of panels without the platforms 500. To accomplish this, the set of panels 210 may be placed on top of a first set of restraint devices inside the compressor 300. A second set of restraint devices may be placed on top of the set of panels 210. The set of panels 210 are then compressed in between the first and second set of restraint devices. Once compressed, the restraint devices may be fastened together. In another embodiment, a single set of restraint devices may be wrapped around the set of panels 210 then compressed. The set of restraint devices is fastened to itself and any excess material may be removed or cut off.

The compressor may generate the compressive force either by forcing out the gases inside the primary and/or secondary pouches 204, 202, for example, with a vacuum, or by applying an external force to the insulator 102 inside the primary and/or secondary pouch 204, 202, for example, with a press 300. While the vacuum process may be effective for single panels, the press 300 is used in the preferred embodiment to compress multiple panels. Some embodiments of the invention may use the vacuum alone.

Modern industry typically utilizes a myriad of box sizes to ship products. Thus, insulation companies should not be limited in the sizes of insulation panels they can produce. The present invention allows "bulk compression" of multiple panels using physical pressure and generally free of size limitations by utilizing a press 300.

Such presses 300 can generate great compressing force to compress the panels 200 to a much smaller volume, thereby increasing the efficiency of storage and transport. Examples of such presses are hydraulic presses, pneumatic presses, electromagnetic presses, vacuums, clamps, weights, and any other type of improvised press or make-shift press that provides a compressive force. These presses can easily generate upwards of twelve tons of force. In some embodiments, both a press 300 and a vacuum may be utilized in conjunction or alone. The panels 200 may first be compressed inside the outer pouch 202, thereafter the outer pouch 202 can be vacuumed prior to sealing. This allows excess material to be available to allow the outer pouch 202 to re-expand at the decompression stage.

The entire process may be automated by implementing a conveyor belt 600 on which the insulators 102 can travel through the packaging and sealing stations 602, 604. The sealing station 604 can seal and cut the primary pouches 204 or simply seal the primary pouches. The automated process may further comprise a folder to fold or arrange a set of panels in the proper configuration. In addition, a second packaging and sealing station may be employed to package the set of panels 210 in the secondary pouch 202 for compression and sealing. The press 300 may also be included in the assembly line. In some embodiments, the press 300 and sealer 302 may be a combined unit.

Thus, the present invention is also directed towards a method of manufacturing an packaging system 100, comprising the steps of providing an insulator 102; enclosing the insulator 102 inside a first pouch 204 to form a panel 200, wherein the first pouch 204 comprises a ventilation hole 208; providing a storage device 202 or 500; placing the panel 200 inside the storage device 202 or 500; applying an external force vacuum or a combination to the container 202 or 500 housing the panel 200; and closing the container 202 or 500, thereby manufacturing the packaging system 100. The storage device 202 or 500 may be a secondary pouch 202, in which case the closing step may be accomplished with a sealer 302, such as a vacuum valve, heat sealer or radiofrequency welder, tape, adhesives, sealants, zip-locks, mechanical closure or any combination. Alternatively, the secondary pouch 202 may have a fastening mechanism, such as a mechanical closure, zip-lock, and the like. In some embodiments, the storage device 202 or 500 may be a rigid or semi-rigid platform 500, in which case the closing step may be accomplished by traditional fastening means. In some embodiments, the storage device may be a restraint device. The external force may be applied with a press 300, such as a hydraulic press or a pneumatic press.

To improve the efficiency of storage and transportation, the method further comprises stacking a plurality of panels inside the second pouch prior to applying the external force.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

INDUSTRIAL APPLICABILITY

This invention may be industrially applied to the development, manufacture, and use of an packaging system comprising a set of panels stored in a compressed state inside a storage device. The panel comprises an insulator contained inside a primary pouch that allows the expulsion and re-entry of air through a ventilation hole. The panels may be interconnected to at least partially form a box.

What is claimed is:

1. A packaging system, comprising:

a. a set of panels, wherein each panel comprises:
   i. a polyurethane foam insulator,
   ii. a primary pouch enclosing the polyurethane foam insulator, and
   iii. a ventilation hole,
   iv. wherein the set of panels comprises at least one connection site in between a first insulator and a second insulator to connect the first insulator to the second insulator in the set of panels, wherein the connection site comprises a flexibility sufficient to allow the set of panels to adopt at least two configurations, wherein in a first configuration adjacent panels form generally right angles with each other, and in a second configuration the panels are parallel to each other;

b. a secondary pouch comprising a gas impermeable material, to maintain the set of panels in a compressed state, wherein the set of panels is in a compressed state, and contained within the secondary pouch which is completely sealed to maintain the set of panels in the compressed state; and c. a storage device configured to maintain the set of panels in the compressed state.

2. The packaging system of claim 1, wherein the gas impermeable material is thermoplastic film containing a vapor barrier material selected from the group consisting of a metalized film, a metal film, a nylon containing film, a metalized polyester, and a vacuum seal material.

3. A packaging system, comprising:

a. at least one panel, wherein the at least one panel is in a compressed state and comprises:
   i. an insulator,
   ii. a primary pouch enclosing the insulator, and
   iii. a ventilation hole; and b. a secondary pouch comprising a gas impermeable material, to maintain the at least one panel in a compressed state, wherein the at least one panel is in a compressed state, and contained within the secondary pouch which is completely sealed to maintain the at least one panel in the compressed state; and c. a storage device configured to maintain the panel in the compressed state.

4. The packaging system of claim 3, wherein the insulator is a foam.

5. The packaging system of claim 3, wherein the insulator is made from recycled material.

6. The packaging system of claim 3, comprising a set of panels, wherein the set of panels comprises:

a. a plurality of insulators; and b. at least one primary pouch, within which at least one insulator is enclosed, wherein each panel in the set of panels is connected with at least one other panel in the set of panels.

7. The packaging system of claim 6, wherein the set of panels forms a linear arrangement.

8. The packaging system of claim 3, comprising a set of panels, wherein the set of panels comprises a plurality of insulators enclosed inside the primary pouch.

9. The packaging system of claim 3, wherein the storage device is selected from the group consisting of a secondary pouch, a platform, and a set of restraint devices.

10. The packaging system of claim 9, wherein the storage device is the secondary pouch.

11. The packaging system of claim 10, wherein the secondary pouch is a gas impermeable plastic film.

12. The packaging system of claim 11, wherein plastic film comprises a gas impermeable material selected from the group consisting of:

a. a metalized film, b. a nylon containing film, c. a metalized polyester, d. a vacuum seal material, e. a metal film, and f. a thermoplastic film.

* * * * *